US011643807B2

(12) United States Patent
Aquilani

(10) Patent No.: US 11,643,807 B2
(45) Date of Patent: May 9, 2023

(54) CLAMP FOR CONNECTING PANELS IN SURFACE COATING STRUCTURE, AND MANUFACTURING METHOD

(71) Applicant: I DECK S.R.L., Vetralla (IT)

(72) Inventor: Enrico Aquilani, Vetralla (IT)

(73) Assignee: I DECK S.R.L., Vetralla (IT)

( * ) Notice: Subject to any disclaimer, the term of this patent is extended or adjusted under 35 U.S.C. 154(b) by 197 days.

(21) Appl. No.: 16/765,092

(22) PCT Filed: Nov. 18, 2018

(86) PCT No.: PCT/IB2018/059080
§ 371 (c)(1),
(2) Date: May 18, 2020

(87) PCT Pub. No.: WO2019/102333
PCT Pub. Date: May 31, 2019

(65) Prior Publication Data

US 2020/0354951 A1 Nov. 12, 2020

(30) Foreign Application Priority Data

Nov. 21, 2017 (IT) ..... 102017000133473

(51) Int. Cl.
*E04B 1/41* (2006.01)
*E04F 15/02* (2006.01)
*E04F 13/08* (2006.01)

(52) U.S. Cl.
CPC ..... *E04B 1/40* (2013.01); *E04F 13/085* (2013.01); *E04F 13/0826* (2013.01); *E04F 15/02044* (2013.01); *E04F 2015/02122* (2013.01)

(58) Field of Classification Search
CPC .... E04B 1/40; E04F 13/085; E04F 15/02044; E04F 2015/02122; E04F 2015/02094; E04F 13/0826; E04F 15/02183; F16B 21/02
See application file for complete search history.

(56) References Cited

U.S. PATENT DOCUMENTS 3,407,454 A * 10/1968 Myatt ..... F16B 21/02 411/549
3,588,968 A * 6/1971 Heilman ..... F16B 21/02 411/509

(Continued)

FOREIGN PATENT DOCUMENTS

DE 29707884 U1 * 9/1997 ..... E04F 13/0826
DE 102013006720 A1 * 10/2014 ..... F16B 21/02

(Continued)

OTHER PUBLICATIONS

Machine Translation of DE 29707884 U1 obtained by the European Patent Office (last accessed on Jun. 10, 2022 at https://worldwide.espacenet.com/patent/search/family/008039831/publication/DE29707884U1?q=29707884) (Year: 1997).*

(Continued)

*Primary Examiner* — Brian D Mattei
*Assistant Examiner* — Charissa Ahmad
(74) *Attorney, Agent, or Firm* — Nixon & Vanderhye

(57) ABSTRACT

A clamp (51) for connecting panels in a surface coating structure on a base frame comprises a fixable element (100) and a rotatable element (200) having an upper part (220), projecting after its rotation from the fixable element (100) and provided with end (21, 22) of engagement in lateral grooves of adjacent panels. The rotatable element (200) has an intermediate part (280) and a lower part (290) which are constituted by two coaxial discs, the disc of the intermediate part (280) having a smaller diameter than the disc of the (Continued)

lower part (290). The fixable element (100) has two communicating coaxial holes (10, 11) housing the intermediate part (280) and the lower part (290) with a wide coupling to allow rotation of the rotatable element (200) with respect to the fixable element (100). A manufacturing process of the clamp (51) is also described.

9 Claims, 5 Drawing Sheets

(56) References Cited

U.S. PATENT DOCUMENTS

| | | | | | |
|---|---|---|---|---|---|
| 3,816,882 | A * | 6/1974 | Maeda | B65D 55/10 | 411/549 |
| 4,074,488 | A * | 2/1978 | Ray, III | E04F 15/02405 | 52/126.6 |
| 4,498,827 | A * | 2/1985 | Mair | A44B 99/005 | 24/691 |
| 4,948,083 | A * | 8/1990 | McNaney, Jr. | A01K 91/08 | 248/289.11 |
| 4,952,107 | A * | 8/1990 | Dupree | F16B 5/0208 | 411/103 |
| 5,094,579 | A * | 3/1992 | Johnson | F16B 35/041 | 411/970 |
| 5,442,141 | A * | 8/1995 | Gretz | H02G 3/081 | 174/152 G |
| 5,647,107 | A * | 7/1997 | Brewster | G09F 7/02 | 24/713.6 |
| 6,131,346 | A * | 10/2000 | Kordes | E04F 13/145 | 52/235 |
| 7,546,661 | B2 * | 6/2009 | Connor, Jr. | B60N 3/046 | 24/297 |
| 8,342,328 | B2 * | 1/2013 | Trapp | B65D 73/0014 | 24/453 |
| D686,943 | S * | 7/2013 | Watson | F16B 21/02 | D11/201 |
| 8,572,818 | B2 * | 11/2013 | Hofmann | F16B 21/078 | 24/297 |
| 8,991,006 | B2 * | 3/2015 | Masanek, Jr. | B60N 3/046 | 428/167 |
| 9,249,570 | B2 * | 2/2016 | Jean | E01C 9/086 | |
| 9,506,255 | B1 * | 11/2016 | Jones | E04F 15/225 | |
| 9,909,309 | B1 * | 3/2018 | Conklin | E04B 5/46 | |
| 10,124,742 | B2 * | 11/2018 | Martinez | F16B 21/073 | |
| 10,156,045 | B2 * | 12/2018 | Penland | E04F 15/107 | |
| 10,428,857 | B2 * | 10/2019 | Kurokawa | F16B 19/10 | |
| 2004/0005430 | A1 * | 1/2004 | Rogers | E01C 5/005 | 428/44 |
| 2011/0262243 | A1 * | 10/2011 | Glickman | F16B 21/02 | 411/347 |
| 2017/0241084 | A1 * | 8/2017 | Else | E01C 11/02 | |

FOREIGN PATENT DOCUMENTS

| | | | | |
|---|---|---|---|---|
| EP | 3106585 | A1 | 12/2016 | |
| EP | 3282066 | A1 * | 2/2018 | E04F 15/02044 |
| FR | 2818677 | A1 * | 6/2002 | E04F 13/0826 |
| GB | 2399108 | A * | 9/2004 | E04C 5/20 |
| WO | 2008/093383 | A1 | 8/2008 | |
| WO | WO-2011149371 | A1 * | 12/2011 | E04F 13/0826 |
| WO | WO-2014098636 | A1 * | 6/2014 | E04F 13/0805 |
| WO | WO-2016083497 | A1 * | 6/2016 | E04F 15/02044 |
| WO | WO-2017194827 | A1 * | 11/2017 | F16B 17/00 |

OTHER PUBLICATIONS

International Search Report, dated Nov. 18, 2018, from corresponding PCT application No. PCT/IB2018/059080.

* cited by examiner

Fig. 9
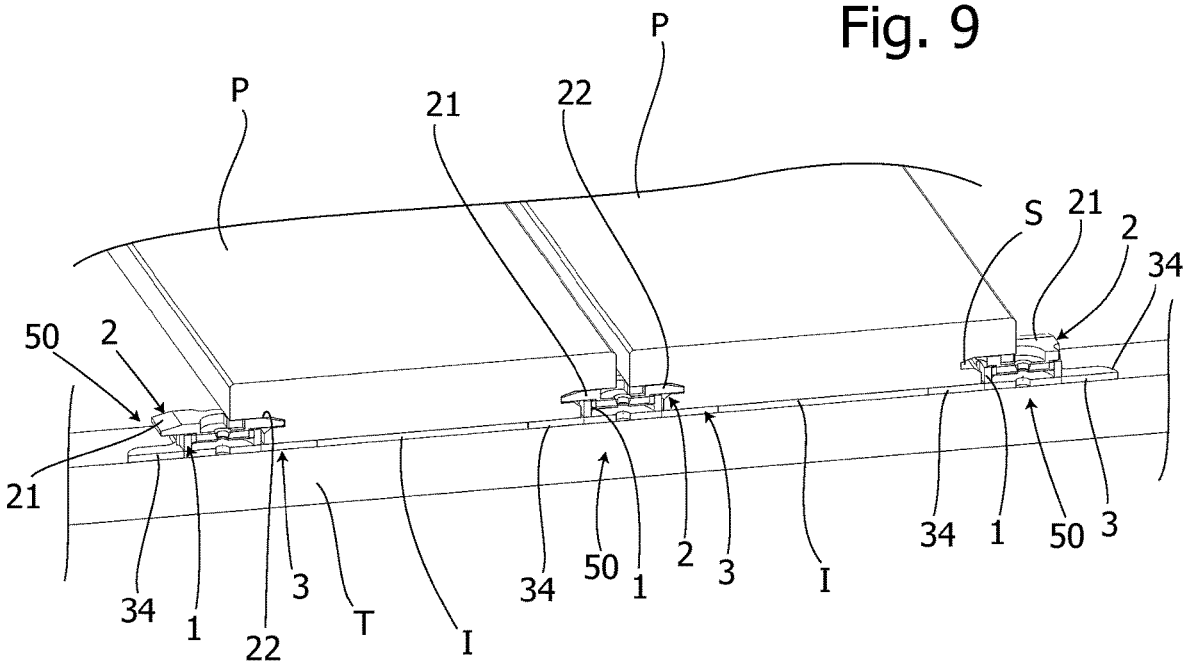
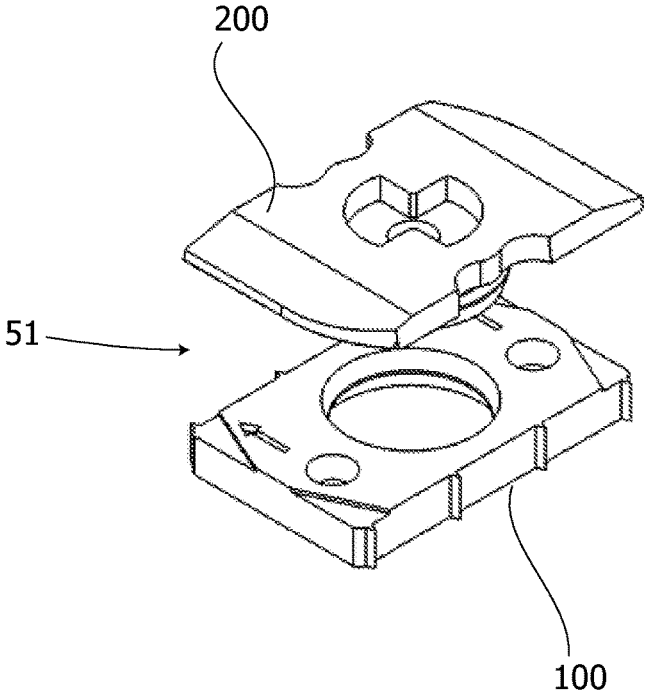
Fig. 10

CLAMP FOR CONNECTING PANELS IN SURFACE COATING STRUCTURE, AND MANUFACTURING METHOD

TECHNICAL FIELD

The present invention relates to a clamp for connecting panels in a surface coating structure.

BACKGROUND ART

In this type of structures the connection, which takes place between the panels and a base frame, is removable and is generally made by means of clamps. WO 2008/093383 A1 discloses a clamp.

DE 297 07 884 U1 describes a clamp formed by two parts, a lower one that can be fixed with screws on the base frame, and an upper one rotatable on the lower part to protrude, with its ends, and pass from a disengagement position between two adjacent panels to a position of engagement of the same with the base frame. To achieve this engagement, the ends of the upper part are inserted into the longitudinal grooves, made for this purpose, in the panels. In the above German document it is shown that the upper part has a plurality of hook-like feet projecting downwards and engaged with a circular opening provided in a raised portion of the lower part. This arrangement allows the upper part of the clamp to rotate with respect to its lower part.

EP 3106585 A1 discloses a fastening system for decking boards including a series of supports connected to a frame. Each support has a stem with a semi-circular washer. The decking boards define slots which run along both sides of the board. The washer is rotated so that it extends into the slot in the side of the decking board. The washer is then fixed in place by a screw.

A drawback of the clamps of the prior art lies in the fact that the rotatable part does not have an efficient support on the base frame.

Another drawback of the clamps of the prior art is due to the fact that the rotatable part is not easily controllable in its position.

Furthermore, the insertion of the rotatable part in the longitudinal grooves of the panels is not facilitated.

SUMMARY OF THE INVENTION

Therefore, the general object of the present invention is to obviate the drawbacks of the prior art.

In particular, an object of the invention is to create a rotatable coupling that is stable and easy to be operated between the upper part and the lower part of a clamp for connecting panels in a surface coating structure.

Another object of the invention is to allow the rotation of the upper part with respect to the lower part with a tool for installing and removing panels.

Yet another object of the invention is to provide a comfortable fastening of the clamp on the base frame.

A further object of the invention is to provide an effective simultaneous gripping of two adjacent panels.

These and other objects and advantages are achieved in a first embodiment of the invention.

In a second aspect of the invention, there is provided a method of manufacturing a clamp for connecting panels in a surface coating structure.

BRIEF DESCRIPTION OF DRAWINGS

Two embodiments are disclosed in the detailed description that follows, referring to the attached drawings in which:

FIG. 9 is a partial perspective view of a surface coating structure in which the clamp according to the present invention is applied;

FIG. 10 is an exploded perspective view of a second embodiment of a clamp;

DESCRIPTION OF INVENTION EMBODIMENTS

Figure 1:
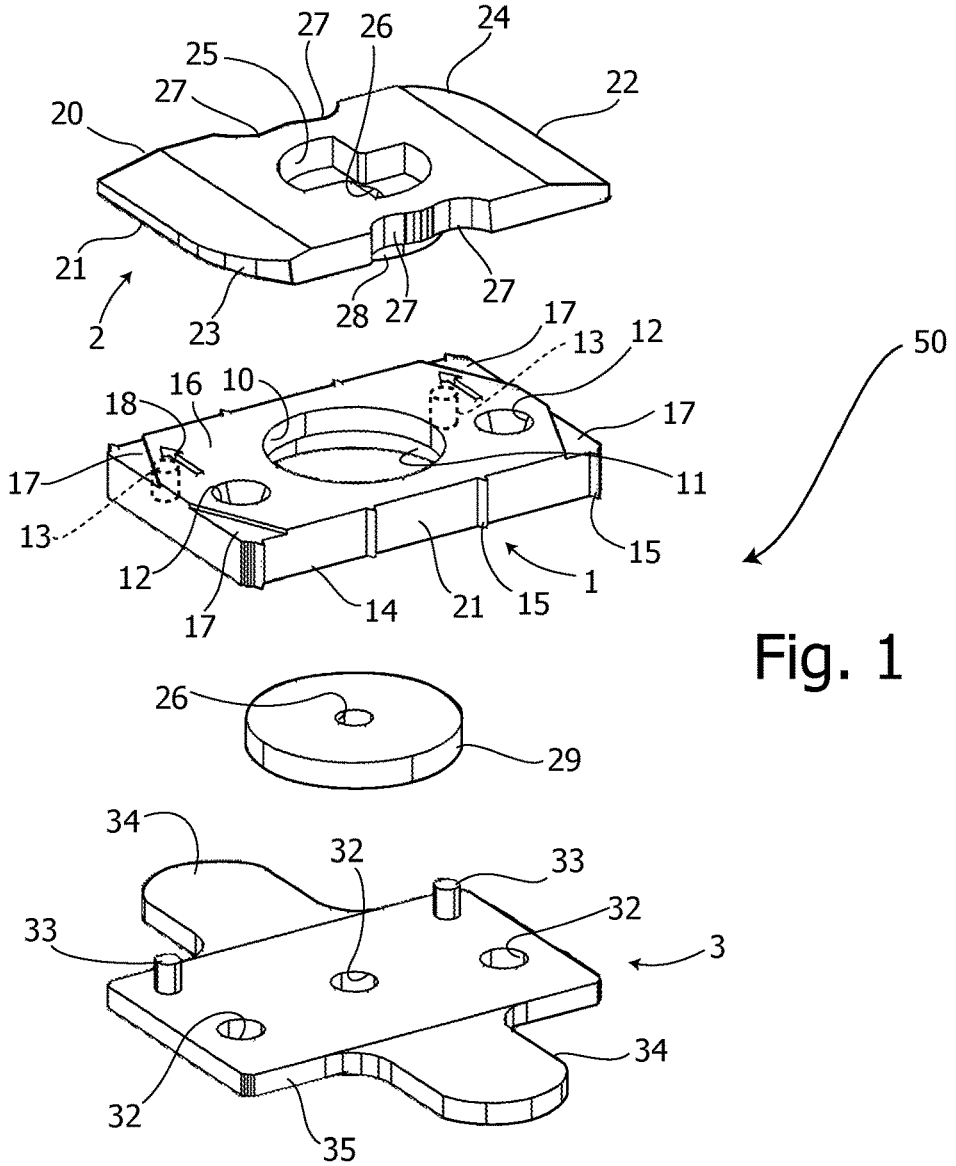
FIGS. 1 and 2 are an exploded and, respectively, assembled perspective view of a first embodiment of the clamp for connecting panels according to the present invention, the clamp being in the open position.
Figure 2:
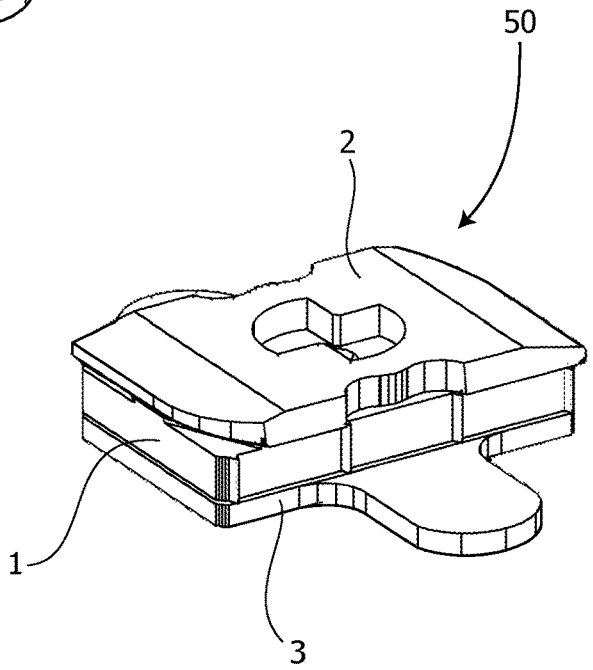
Figure 3:
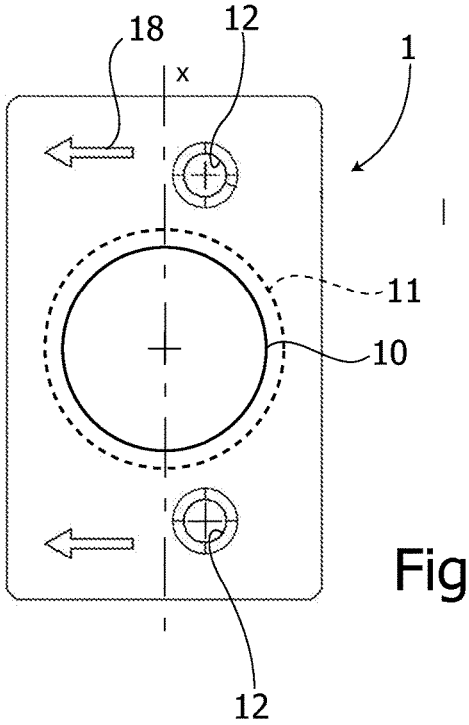
FIGS. 3 and 4 are a top plan view and a side view, respectively, of an element of the clamp which can be fastened to the base frame.

First of all, reference is made to FIGS. 1 and 2, which are an exploded and assembled perspective view, respectively, of a clamp for connecting panels according to a first embodiment of the present invention in an open position. The configuration of the surface coating structure in which the clamp is applied is widely known in the art. However, an example is given in FIG. 9, which is a partial perspective view of a surface coating structure in which the clamp according to the present invention is applied. In FIG. 9, indicated as P are panels and as T a base frame, and clamps according to a first embodiment of the present invention are generically indicated as 50.

Returning to FIGS. 1 and 2, the clamp 50 comprises a fixable element 1, i.e. that it is designed to be fixed to the base frame T (FIG. 9), and a rotatable element 2, that is rotatably connected to the fixable element 1. Preferably, the fixable element 1 can be fixed on the base frame with the interposition of a support plate 3.

The fixable element 1, which is rectangular prismatic with central longitudinal axis x, has two communicating concentric cylindrical holes: an upper hole 10 of smaller diameter with respect to a lower hole 11. Moreover, the fixable element 1 has two through holes generally indicated as 12, having a truncated conical invitation from the top. The through holes 12 are offset with respect to the longitudinal symmetry plane of the fixable element 1. Furthermore, the fixable element 1 has two blind holes 13 made from the bottom towards its top. The long sides 14 of the fixable element 1 have a plurality of vertical ridges 15, preferably with a triangular cross-section. They have the function of spacers with respect to the adjacent panels. When the panels dilate due to weather changes, their deformations are compensated by their possibility of expansion against the clamps. Obtained on the top surface 16 of the fixable element 1, in the vicinity of the corners, are angular depressions indicated as 17 to facilitate rotation of the rotatable element 2 with respect to the fixable element 1. On the top surface 16 of the fixable element 1 there are shown a pair of arrows 18 indicating the positioning direction of the clamp 50 with respect to the panel to its left. Furthermore, two segments 37 being orthogonal to the arrows 18 indicate the correct positioning of the rotatable element 2 with respect to the fixable element 1, when the rotatable element 2 is in the closed position of the clamp. For clamping, the segments 37 must be in the same direction as slit between adjacent panels P.

The rotatable element 2 has an upper part 20 which, after the assembly of the clamp 50, protrudes upwardly with respect to the top surface 16 of the fixable element 1. The rotatable element 2 has the shape of a rectangular plate with size substantially equal to that of the fixable element 1. Conventionally, the rotatable element 2 engages, in its rotation, with its ends in lateral grooves of adjacent panels P, as shown in FIG. 9. The upper part 20 of the element rotatable 2 is tapered toward the bottom in the short sides 21, 22 of the rectangular plate. The tapered short sides 21, 22 are beveled in two diametrically opposed corners 23, 24 thereof. Centrally, the upper part 20 of the rotatable element 2 has a butterfly-shaped cavity 25 for engagement with a rotation key, for example a T key, and has a central hexagonal hole 26 for engagement with an Allen key or for passing a fastening screw (not shown) of clamp 50 to the base frame. Curved recesses 27 are made centrally on the long sides of the upper part 20 of the rotatable element 2 for a purpose which will be clarified below.

Moreover, the rotatable element 2 has, preferably in one piece with the upper part 20, an intermediate part 28 in the form of a disc of such dimensions as to be rotatably received in the upper hole 10 of the fixable element 1. Finally, the rotatable element 2 has a disc-shaped lower part 29, with a diameter greater than the diameter of the intermediate part 28 but such to be rotatably received in the lower cylindrical hole 11 of the fixable element 1. The lower part 29 of the rotatable element 2 is received, as the intermediate part 28, with a wide coupling to allow rotation of the rotatable element 2 with respect to the fixable element 1. The joining of the intermediate part 28 with the lower part 29 can be by gluing, but preferably by ultrasonic welding, since the clamp 50 according to the present invention is made of plastic material. The central hexagonal hole 26 continues in the intermediate part 28 as well as in the lower part 29 of the rotatable element 2.

The support plate 3 has a rectangular plan with through holes 32 concentric with the through holes 12 of the fixable element 1, and furthermore a pair of mounting pins 33 concentric with the blind holes 13 of the same fixable element 1. The support plate 3 extends in two opposite side arms 34, centrally formed on the long sides 35 of its rectangular plan.

According to the invention, a manufacturing process of the clamp 50 for connecting panels in a surface coating structure is provided. The prismatic fixable element 1 is molded in plastic material with the two concentric holes, the upper one 10 having a smaller diameter than the lower one 11. The rotatable element 2 is also molded in plastic material with its upper part 20 in one piece with the intermediate part 28 constituted by a disc of diameter such as to be rotatably received in the upper cylindrical hole 10 of the fixable element 1. The intermediate part 28 of the rotatable element 2 is inserted into the upper cylindrical hole 10 of the fixable element 1 while the lower part 29 of the rotatable element 2 is rigidly joined to its intermediate part 28. Alternatively, the intermediate part 28 and the lower part 29 could be made in one piece and subsequently joined rigidly to the upper part 20, when positioned on either side of the fixable element 1.

Figure 4:
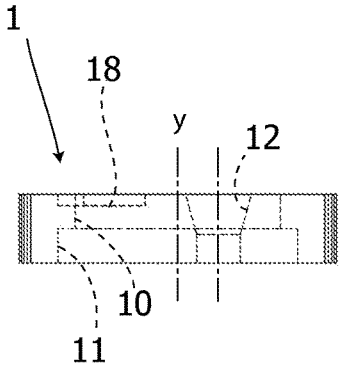
Figure 5:
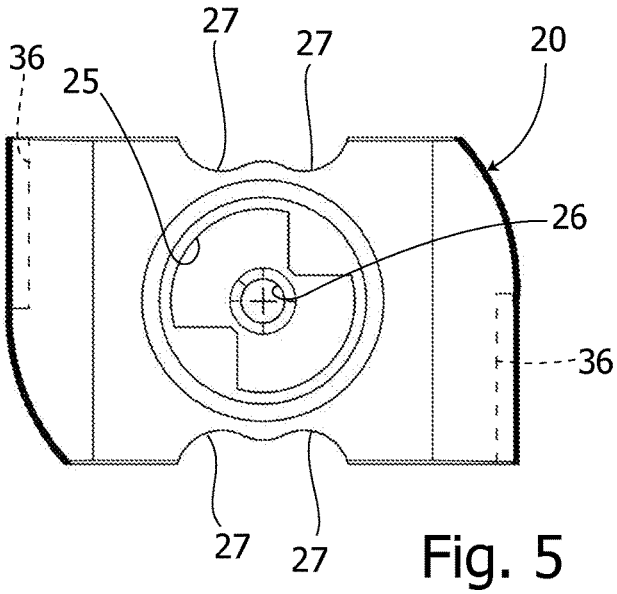
FIGS. 5 and 6 are a top plan view and a side view, respectively, of the rotatable element of the clamp in FIGS. 1 and 2.

The rigid joining between the lower part 29 of the rotatable element 2 and the intermediate part 28 can be achieved by means of an ultrasonic welding sonotrode. As previously stated, the fixable element 1 has two through holes 12 near its short sides being offset with respect to the central longitudinal axis x of the fixable element 1, and the rotatable element 2 has a double pair of opposite recesses 27 in the its long sides. The recesses 27 have a circular sector shape. When the rotatable element 2 is rotated about the axis y (FIGS. 4 and 6) that is perpendicular to the central longitudinal axis x of the fixable element 1, a pair of opposite recesses 27 are located with their axis of curvature concentric with the two through holes 12. Thus, if the fixable element 1 is fastened with screws to the base frame through the holes 12, the clamp 50 can be easily mounted and disassembled from the base frame by acting with a screwdriver on the screws (not shown) in the through holes 12.

Figure 6:
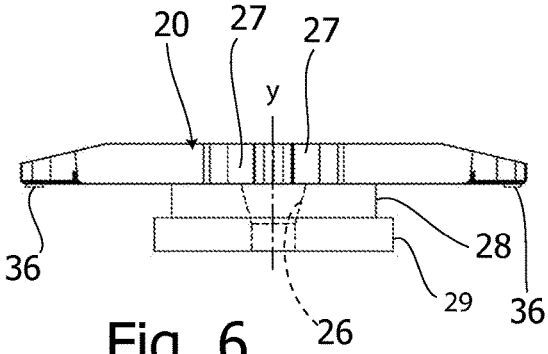
Figure 7:
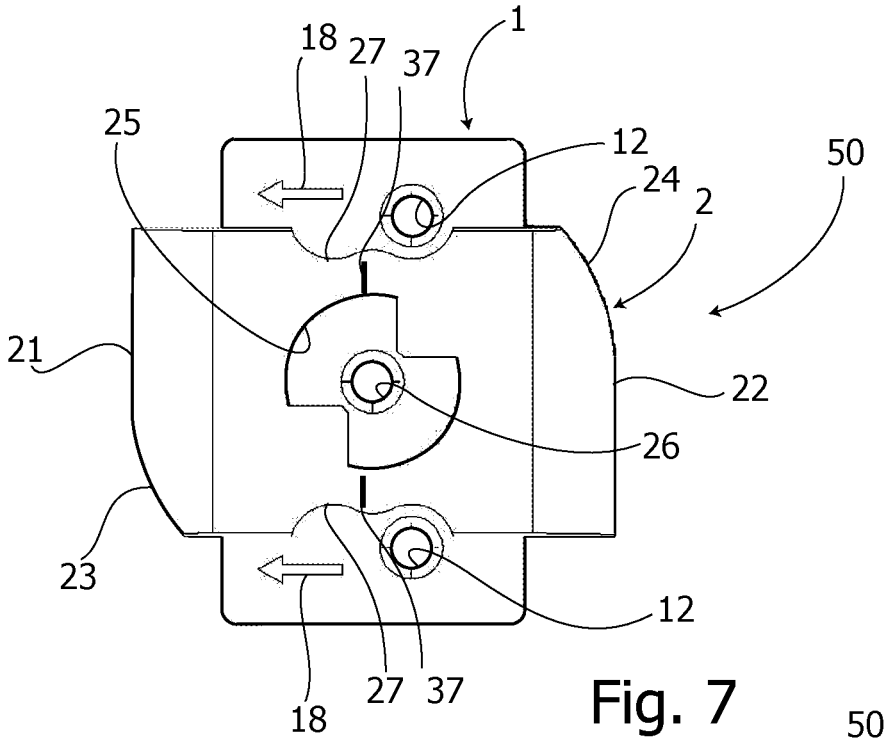
FIGS. 7 and 8 are a plan view from above and a perspective view of the clamp in FIG. 2, without the support plate and in a closed position.
Figure 8:
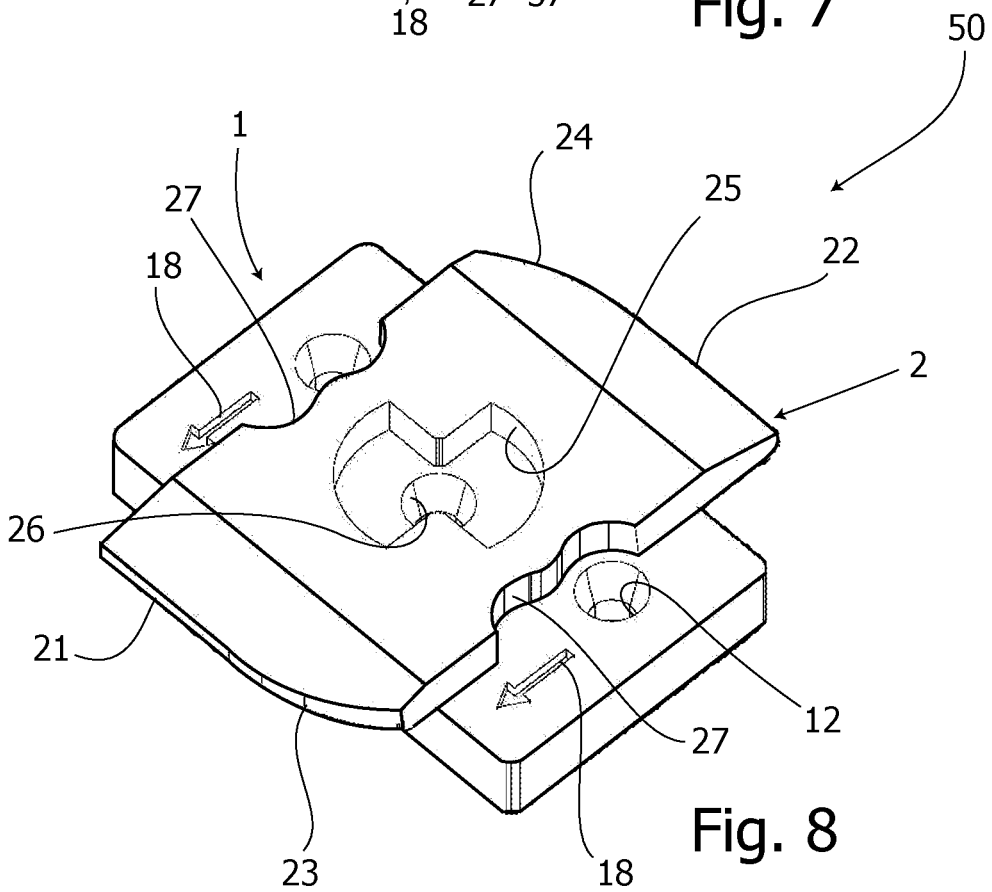
Figure 11:
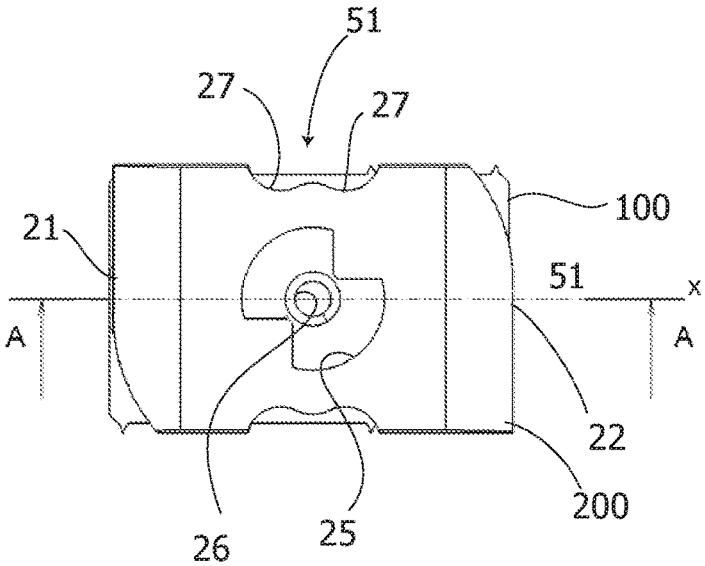
FIG. 11 is an exploded top plan view of the clamp in FIG. 10.
Figure 12:
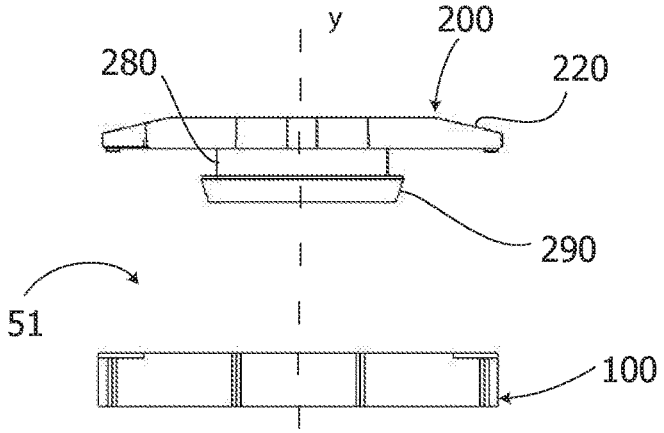
FIG. 12 is an exploded side view of the clamp in FIG. 10.
Figure 13:
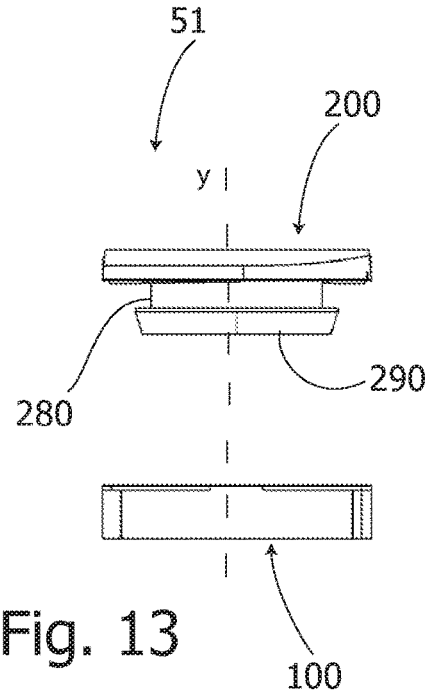
FIG. 13 is an exploded end view of the clamp in FIG. 10.
Figure 14:
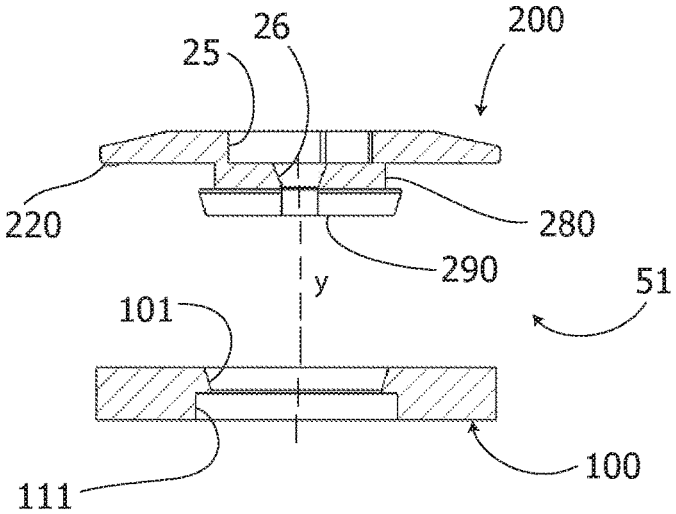
FIG. 14 is an exploded cross-section view along the line A-A of the clamp in FIG. 11.

The fixable element 1 has superiorly the triangular depressions 17 on the top surface 16 at each corner. The depressions serve to facilitate the rotation of the rotatable element 2 with respect to the fixable element 1, which has inferiorly projections 36 (FIG. 6).

Carved superiorly in the fixable element 1 are two parallel arrows 18 orthogonal to the lateral grooves of the panels. The arrows 18 serve to indicate the positioning direction of the clamp 50 and are directed towards the panel to its left with respect to its longitudinal direction.

The fixable element 1 has at its bottom two blind holes 13 which receive the pins 33 of the support plate 3 for a precise and stable positioning of the fixable element 1 on the base frame. The opposite lateral arms 34 of the support plate 3 serve to widen the gripping surface of the clamp 50 since they are placed under the panel opposite to the wings 21, 22 of the upper part 20 when the clamp 50 is in the closed position. In this way, the panels are sandwiched by the clamps.

This is shown in the aforementioned FIG. 9, wherein clamps 50 are fixed on a base frame T to retain the panels P. The panels P rest on the opposite side arms 34 of the support plates 3. In this way, the panels P do not rest in contact with the base frame T, with result that an interspace I is formed which avoids stagnant water. In the closed position the wings 21, 22 of the upper part 20 of a same rotatable element 2 are inserted into the lateral grooves S of panels P that are adjacent.

Reference is made now to FIG. 10 which is an exploded perspective view of a second embodiment of a clamp, and to FIGS. 11, 12, 13 and 14 which are exploded top, side, end plan and cross-section views thereof along line A-A. Identical or similar reference numerals are used to mark parts that are the same or similar to those of the first embodiment.

The clamp of the second embodiment of the invention, indicated as 51, differs from the clamp 50 of the first embodiment in the connection of the rotatable element, indicated as 200, with the fixable element, indicated as 100.

The difference of this connection lies in the fact that the disc of the intermediate part 280 of the rotatable element 200 is cylindrical, while the disc of the lower part 290 is tapered downwards, having a diameter larger than the intermediate part 280; moreover, the fixable element 100 has the upper hole 101 that is tapered downwards and the lower hole 111 that is cylindrical.

The lower part 290 of the rotatable element 200 and the upper hole 101 of the fixable element 100 are correspondingly tapered for the forced insertion of one in the other, with the possibility that the two parts may have a relative movement. For this purpose, the dimensions in which the above cooperating parts are made are important. Preferably, the cylindrical disc of the intermediate part 280 has a thickness of 3.1 mm and a diameter of 20 mm, while the disc tapered downwards of the lower part 290 has a thickness of 2.7 mm and a maximum diameter of 21 mm The taper of the downwardly tapered disc of the lower part 290 is 69.16 degrees. The fixable element 100 has the upper hole 101 that is tapered downwardly with a maximum diameter slightly smaller than the maximum diameter of the tapered disc of the lower part 290 and a lower hole 111 that is cylindrical with a diameter of 21.3 mm and a thickness of 2.8 mm. However, these measures are to be considered indicative and not characterizing.

It should be understood that the insertion of the rotatable member 200 in the fixable element 100 is allowed by the elastic deformation of the material with which they are made. The insertion is stable because the two parts can be scarcely stressed to a traction that can determine an accidental separation thereof.

The second embodiment is certainly more convenient thanks to a substantial reduction of the time necessary for its manufacture, and therefore of its cost.

It is understood that the intended objects have been achieved by the invention: to create a stable and comfortable rotatable coupling to be operated between the rotatable element and the fixable element of a clamp for connecting panels in a surface coating structure; to allow the rotation of the upper part with respect to the lower part with a tool for installing and removing panels; to make the fixing of the clamp on the base frame more comfortable; and finally to make the simultaneous gripping of two adjacent panels more effective. Furthermore, the dimensions of the slits between one panel and the next one are considerably reduced.

The invention claimed is:

1. A clamp for connecting panels in a surface coating structure to a base frame (T), the clamp (51) comprising:

a fixable element (100), that is rectangular prismatic, to be fixed to the base frame (T), having long sides (14), a top surface (16), a central longitudinal axis (x), an upper hole (101) and a lower hole (111), both communicating and concentric along an axis (y) perpendicular to the central longitudinal axis (x);

a rotatable element (200) rotating with respect to the fixable element (100) about the axis (y), the rotatable element (200) having an upper part (220) that projects from the fixable element (100) after its rotation, and is provided with ends (21, 22) engaging lateral grooves of panels (P) that are adjacent, an intermediate part (280), which is formed by a first disc and housed in the upper hole (101) of the fixable element (100), and a lower part (290), which is formed by a second disc, having a diameter larger than the disc of the intermediate part (280), and being housed in the lower hole (111) of the fixable element (100) with a clearance fit, in order to enable the rotation of the rotatable element (200) with respect to the fixable element (100), wherein the upper hole (101) of the fixable element (100) is tapered downwardly and the lower hole (111) of the fixable element (100) is cylindrical, wherein the first disc of the intermediate part (280) of the rotatable element (200) is cylindrical and the second disc of the lower part (290) of the rotatable element (200) is tapered downwardly, and wherein the fixable element (100) has two blind holes (13) on its bottom surface; and a support plate (3) having a cross-shaped plan, consisting of a rectangular body having a plan like that of the fixable element (100) and provided with through holes (32) concentric to the through holes (12) of the fixable element (100) and to the central hexagonal hole (26) of the rotatable element (200), and opposite lateral arms (34) radiused to the rectangular plan of the support plate (3) on its long sides, the support plate (3) having two pins (33) that can be inserted into the two blind holes (13) of the fixable element (100).

2. The clamp according to claim 1, wherein the upper part (220) of the rotatable element (200) is prismatic with rectangular plan, superiorly tapered downwardly towards the short sides (21, 22) of the rectangular plan.

3. The clamp according to claim 2, wherein the short sides (21, 22) being tapered are beveled in two diametrically opposite vertexes (23, 24).

4. The clamp according to claim 1, wherein the upper part (220) of the rotatable element (200) has a butterfly-shaped cavity (25) for engagement with a rotation key, the butterfly-shaped cavity (25) being provided with a central hexagonal hole (26) for engagement of an Allen key.

5. The clamp according to claim 1, wherein the fixable element (100) has two through holes (12) that are offset with respect to the central longitudinal axis (x), and the rotatable element (200) has at least one pair of opposite recesses (27) that are concentric with said two through holes (12) of the fixable element (100) when the rotatable element (200) is rotated about the axis (y).

6. The clamp according to claim 5, wherein the fixable element (100) has vertical ridges (15) with a triangular section on its long sides (14).

7. The clamp according to claim 1, wherein the fixable element (100) has triangular depressions (17) on the top surface (16) at each corner.

8. The clamp according to claim 1, wherein the fixable element (100) has superiorly two engraved parallel arrows (18) orthogonal to the lateral grooves of the panels.

9. The method for manufacturing a clamp (51) for connecting panels in a surface coating structure as defined in claim 1, wherein:

the fixable element (100) is molded in one piece of plastic material;

the rotatable element (200) is molded in one piece of plastic material; and the rotatable element (200) is mounted by press fitting into the fixable element (100) so that the lower part (290) of the rotatable element (200) passes through the upper hole (101) of the fixable element (100) and is placed in the lower hole (111) of the fixable element (100), the intermediate part remaining in the upper hole (101) of the fixable element (100).

* * * * *